US009376809B1

(12) United States Patent
Trover

(10) Patent No.: US 9,376,809 B1
(45) Date of Patent: Jun. 28, 2016

(54) DECKING MEMBER

(71) Applicant: PRODECK 50, Inc., Huntington Beach, CA (US)

(72) Inventor: William Trover, Huntington Beach, CA (US)

(73) Assignee: Prodeck 50, Inc., Huntington Beach, CA (US)

( * ) Notice: Subject to any disclaimer, the term of this patent is extended or adjusted under 35 U.S.C. 154(b) by 0 days.

(21) Appl. No.: 14/550,880

(22) Filed: Nov. 21, 2014

(51) Int. Cl.
*E04B 5/02* (2006.01)
*E04C 2/42* (2006.01)
*A47B 96/02* (2006.01)

(52) U.S. Cl.
CPC ..... *E04B 5/02* (2013.01); *A47B 96/021* (2013.01); *E04C 2/42* (2013.01); *E04C 2/427* (2013.01)

(58) Field of Classification Search
CPC .... A47B 96/02; A47B 96/021; A47F 5/0043; A47F 5/0018; E04C 2/427; E04C 2/42; E04B 5/02
USPC ..... 211/134, 135, 186, 187, 153, 189; 29/897.3; 108/24, 57.21, 57.22, 64; 52/798.1, 799.1, 581
See application file for complete search history.

(56) References Cited

U.S. PATENT DOCUMENTS 520,191 A * 5/1894 Snead et al. ..... 211/153
765,963 A * 7/1904 Evans ..... 52/581
1,076,017 A * 10/1913 Chase ..... 52/180
1,494,823 A * 5/1924 Tappen ..... 52/633
1,868,107 A * 7/1932 Lachman et al. ..... 52/581
1,986,998 A * 1/1935 Burgess et al. ..... 52/483.1
2,960,238 A * 11/1960 Park ..... 211/134
2,999,569 A * 9/1961 Wilson ..... 52/584.1
3,057,271 A * 10/1962 Butler et al. ..... 52/179
3,093,216 A * 6/1963 Dunham ..... 52/180
3,215,118 A * 11/1965 Behlen ..... 52/143
3,268,089 A * 8/1966 Hall ..... 211/153
3,556,309 A * 1/1971 Schreyer et al. ..... 211/153
3,561,374 A * 2/1971 Honderich ..... 108/57.22
3,643,607 A * 2/1972 MacKenzie ..... 108/180
3,724,078 A * 4/1973 Carlin et al. ..... 52/177
3,812,636 A * 5/1974 Albrecht et al. ..... 52/334
3,856,344 A * 12/1974 Loeber ..... 296/204
3,986,462 A * 10/1976 Heft ..... 108/188
4,198,795 A * 4/1980 Barnidge ..... 52/180
4,566,243 A * 1/1986 Dahlin ..... 52/578
RE32,248 E * 9/1986 Blecher ..... 210/163
4,691,493 A * 9/1987 Larsen ..... 52/588.1
4,709,642 A * 12/1987 Briosi ..... 108/187
4,955,490 A * 9/1990 Schafer ..... 211/187
5,199,240 A * 4/1993 Ewald, Jr. ..... 52/798.1
5,199,582 A * 4/1993 Halstrick ..... 211/135
5,321,928 A * 6/1994 Warneke ..... 52/581
6,050,428 A * 4/2000 Hollander ..... 211/186
6,062,401 A * 5/2000 Hall et al. ..... 211/187
6,401,944 B1 * 6/2002 Kircher et al. ..... 211/134

(Continued)

FOREIGN PATENT DOCUMENTS

CH 362206 A * 5/1962
DE 2316229 A1 * 10/1974

(Continued)

*Primary Examiner* — Stanton L Krycinski
(74) *Attorney, Agent, or Firm* — Plager Schack LLP

(57) ABSTRACT

A decking member having a plurality of panels each with first and second side supports. The plurality of panels can each have a plurality of slots forming an open deck of at least 50%.

3 Claims, 8 Drawing Sheets

(56) References Cited

U.S. PATENT DOCUMENTS

| | | | | |
|---|---|---|---|---|
| 6,408,586 | B1 * | 6/2002 | Deckert | 52/630 |
| 6,415,581 | B1 * | 7/2002 | Shipman et al. | 52/798.1 |
| 7,055,704 | B2 * | 6/2006 | Alter | 211/153 |
| 7,066,685 | B2 * | 6/2006 | Humphries et al. | 405/43 |
| 7,156,243 | B2 * | 1/2007 | Henning et al. | 211/153 |
| 7,188,742 | B2 * | 3/2007 | Skulnik | 211/135 |
| 7,228,978 | B2 * | 6/2007 | Cross | 211/153 |
| 7,857,152 | B2 * | 12/2010 | Smith | 211/187 |
| 7,891,507 | B2 * | 2/2011 | Shetler | 211/135 |
| 2004/0251224 | A1 * | 12/2004 | Kircher et al. | 211/153 |
| 2004/0251225 | A1 * | 12/2004 | Cross | 211/153 |
| 2005/0150852 | A1 * | 7/2005 | Henning et al. | 211/153 |
| 2006/0060550 | A1 * | 3/2006 | Cross | 211/134 |
| 2006/0086683 | A1 * | 4/2006 | Skulnik | 211/135 |
| 2008/0169256 | A1 * | 7/2008 | Shetler | 211/153 |
| 2009/0159545 | A1 * | 6/2009 | Shetler | 211/153 |

FOREIGN PATENT DOCUMENTS

| | | | | |
|---|---|---|---|---|
| DE | 2851120 | A1 | * | 6/1980 |
| DE | 3021090 | A1 | * | 10/1981 |
| DE | 29601819 | U1 | * | 3/1996 |
| DE | 19716435 | A1 | * | 10/1998 |
| DE | 10105126 | C1 | * | 6/2002 |
| EP | 1106108 | A1 | * | 6/2001 |
| GB | 783838 | A | * | 10/1957 |
| GB | 1604232 | A | * | 12/1981 |

* cited by examiner

DECKING MEMBER

BACKGROUND OF THE INVENTION

1. Field of the Invention

Embodiments of the present invention generally relate to decking. Some embodiments may be used in shelving systems. The disclosed systems also relate to decking for stairs and other types of structures and structural systems.

2. Description of the Related Art

Heavy-duty shelving systems are often made of steel frames with separate decking for the shelves. The decking is often made of slats of wood or a wielded wire grid. These racks can be used for hand-stacking applications and for pallet supports. These types of heavy-duty shelving systems are frequently used in factories, warehouse type stores, home improvement type stores, storage facilities, distribution centers, etc.

As these systems are frequently used in a public and/or permanent setting, they can be subject to certain regulations under state and local building codes. These regulations can include fire safety mandates that require certain fire ratings, as well as the requirement that a certain percentage of water pass through the shelving units (i.e., from overhead sprinkler systems) to reach the ground.

The currently available systems are often overly heavy, thereby reducing the capacity of the shelving unit. This is because of the weight of the decking takes away from the maximum load the system can handle. Thus, the heavier the decking, the less storage capacity in terms of weight the system can hold. In addition, heavy decking systems are difficult for individuals to install and/or manipulate. More than one person is often required to adjust shelves that can weigh half their body weight and more. Other problems experienced by the current systems include increased costs associated with wielding each joint of the wire grid, the large gaps that can form between wooden slats creating a safety issue, as well as the inability to meet certain state and local building codes.

SUMMARY OF THE INVENTION

For the reasons discussed above, there exists a need for improved decking and shelving systems that, for example, meet and/or exceed current building codes, reduce the cost of manufacture, and reduce the weight of the shelving system while increasing load capacity.

A decking member configured for use with a shelving unit according to certain embodiments can comprise a plurality of panels, each panel comprising a plurality of slots; first and second side supports being on opposite sides of each of the plurality of panels, each connected to and extending along the length of one side of separate panels among the plurality of panels, the side supports extending in a direction generally transverse to the panels; and at least one side support from each of the plurality of panels connected to another side support from an adjacent panel. Each of the plurality of panels and its first and second side supports can be roll-formed of a single piece of material.

In certain embodiments, the at least one side support from each of the plurality of panels connected to another side support from an adjacent panel is welded together. In some embodiments, the connection between the side supports is open such that water can pass into the connection from the upper surface of the panels. Of some of these embodiments, the connections and the slots make up an open deck of at least 50%.

Some embodiments of a decking member have slots formed by punching a hole and then drawing the hole to form the slot. At least a portion of the material circumscribing the hole used to form the slot is bent to extend generally in the direction of the side supports. This can increase the strength of the decking member.

A shelving system according to certain embodiments can comprise a frame and at least one decking member.

A method of making a decking member can comprise first cutting a first piece of material to a desired shape, wherein the first piece of material is flat. Then, punching out a plurality of slits along a length of the first piece of material, wherein the length is substantially in the center of the first piece of material. Next, roll-forming the first piece of material to create side supports substantially in an L-shape such that the first piece of material is no longer flat. Then, drawing the plurality of slits to create a plurality of slots larger than the slits, wherein at least a portion of the excess material circumscribing the slits is forced downward from a top of the first piece of material. Additional steps can include cutting, punching, roll-forming and drawing a second piece of material in substantially the same manner as the first piece of material and connecting a side support of the first piece of material to a side support of the second piece of material.

In certain methods the step of connecting a side support of the first piece of material to a side support of the second piece of material comprises welding the side supports together.

Some methods can further comprise cutting, punching, roll-forming and drawing a third and fourth piece of material in substantially the same manner as the first piece of material and connecting one side support of the third piece of material to a side support of the second piece of material and the other side support of the third piece of material to a side support of the fourth piece of material.

A decking member of some embodiments can comprise a plurality of panels, first and second side supports, and at least one center support. One or more of the panels can comprise a plurality of slots. The slots can allow the decking to have a minimum of 50% open deck. The first and second side supports can be on opposite ends of the decking member, each can be connected to and extending along the length of one side of separate panels among the plurality of panels. In addition, the side supports can be generally perpendicular to the panels and can form the shape of an L or C and may include a V-notch along the top. The at least one center support can be between the panels and can connect the panels. The at least one center support can have a region perpendicular to the panels and a triangular base. According to some embodiments, the decking member can be roll-formed of a single piece of material and the relationship of the plurality of panels, first and second side supports, and at least one center support can be established by a series of folds in the single piece of material.

A shelving system according to some embodiments can comprise a frame and at least one decking member. The decking member can comprise a plurality of panels, first and second side supports, and at least one center support. Each panel can comprise a plurality of slots. The first and second side supports can be on opposite ends of the decking member, each can be connected to and extending along the length of one side of separate panels among the plurality of panels. In addition, the side supports can be generally perpendicular to the panels and can be formed in the shape of an L or C and may include an indentation along the top. The at least one center support can be between and connecting the panels. The at least one center support can have a region perpendicular to the panels and can have a triangular base. According to some embodiments, the decking member can be rollformed of a single piece of material.

A decking member of certain embodiments can further comprise a plurality of hooks. The plurality of hooks can be part of the single piece of material or can be welded or otherwise joined to the member. The plurality of hooks according to some embodiments can be attached to the center support at a bottom of the triangular base.

These and other objects of embodiments of the present invention will become readily apparent upon further review of the attached drawings and specification.

BRIEF DESCRIPTION OF THE DRAWINGS

The features and advantages of embodiments of the invention, and the manner of attaining them, will become apparent by reference to the following description of preferred embodiments of the invention taken in conjunction with the accompanying drawings.

DETAILED DESCRIPTION OF THE PREFERRED EMBODIMENTS

Figure 1:
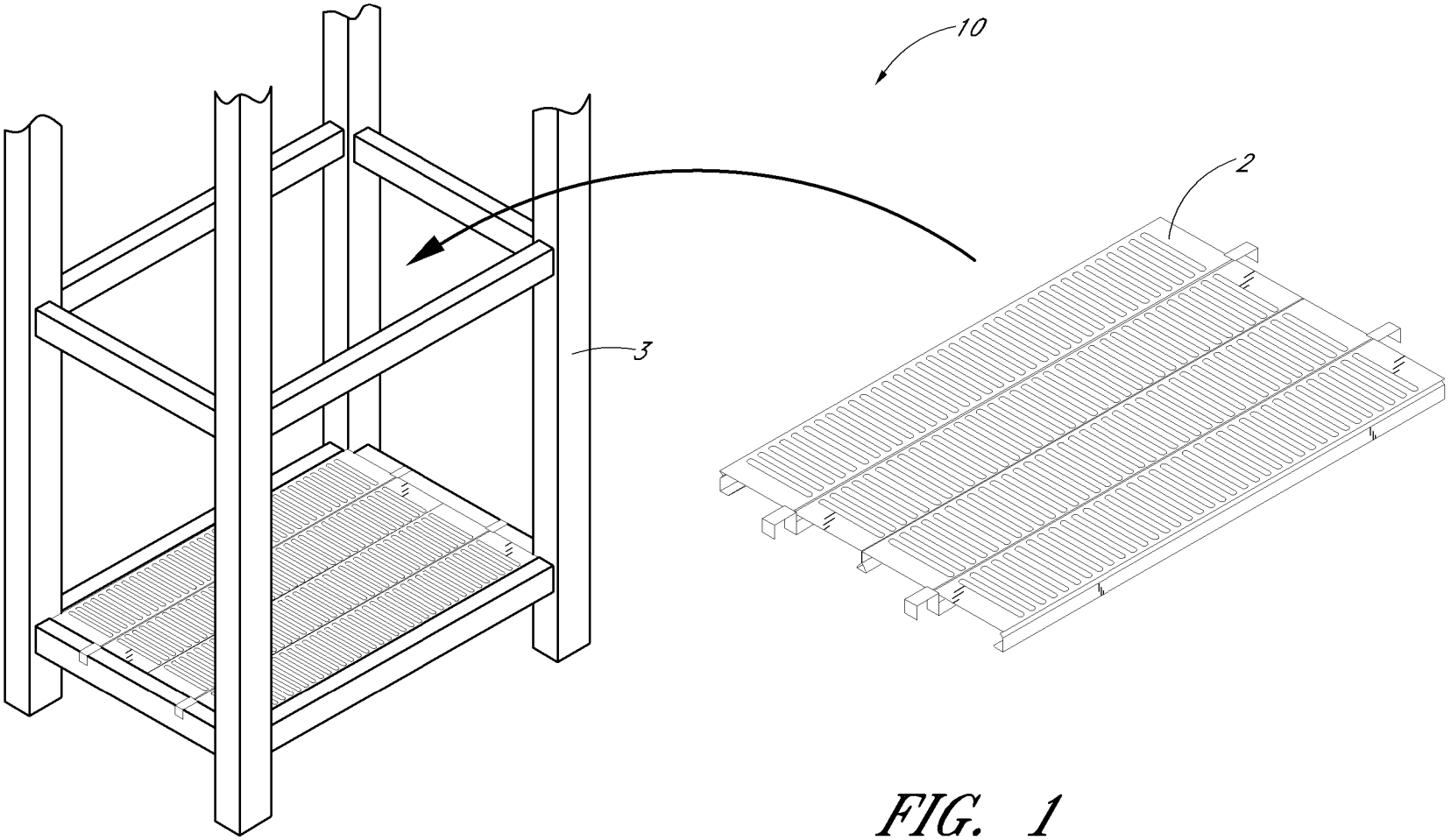
FIG. 1 is an isometric view of an embodiment of a shelving system incorporating some embodiments of decking members.

The embodiments shown in FIG. 1 illustrate a rack or shelving unit 10 with decking 2 and frame 3. The rack 10 is shown with two decking members 2. In other embodiments, the rack 10 can have 1, 2, 3 or more decking members 2. Additionally, certain embodiments can comprise multiple racks 10 with multiple decking members 2. Other embodiments can comprise one rack 10 with multiple frames 3 and multiple decking members 2.

The decking 2 according to one embodiment can be of one piece steel construction that is roll-formed. Roll-forming can include a continuous bending operation in which a long strip of metal (typically coiled steel) is passed through consecutive sets of rolls, or stands, each performing only an incremental part of the bend, until the desired crosssection profile is obtained. In the preferred embodiment, the steel used can be 20 gauge steel.

Figure 2:
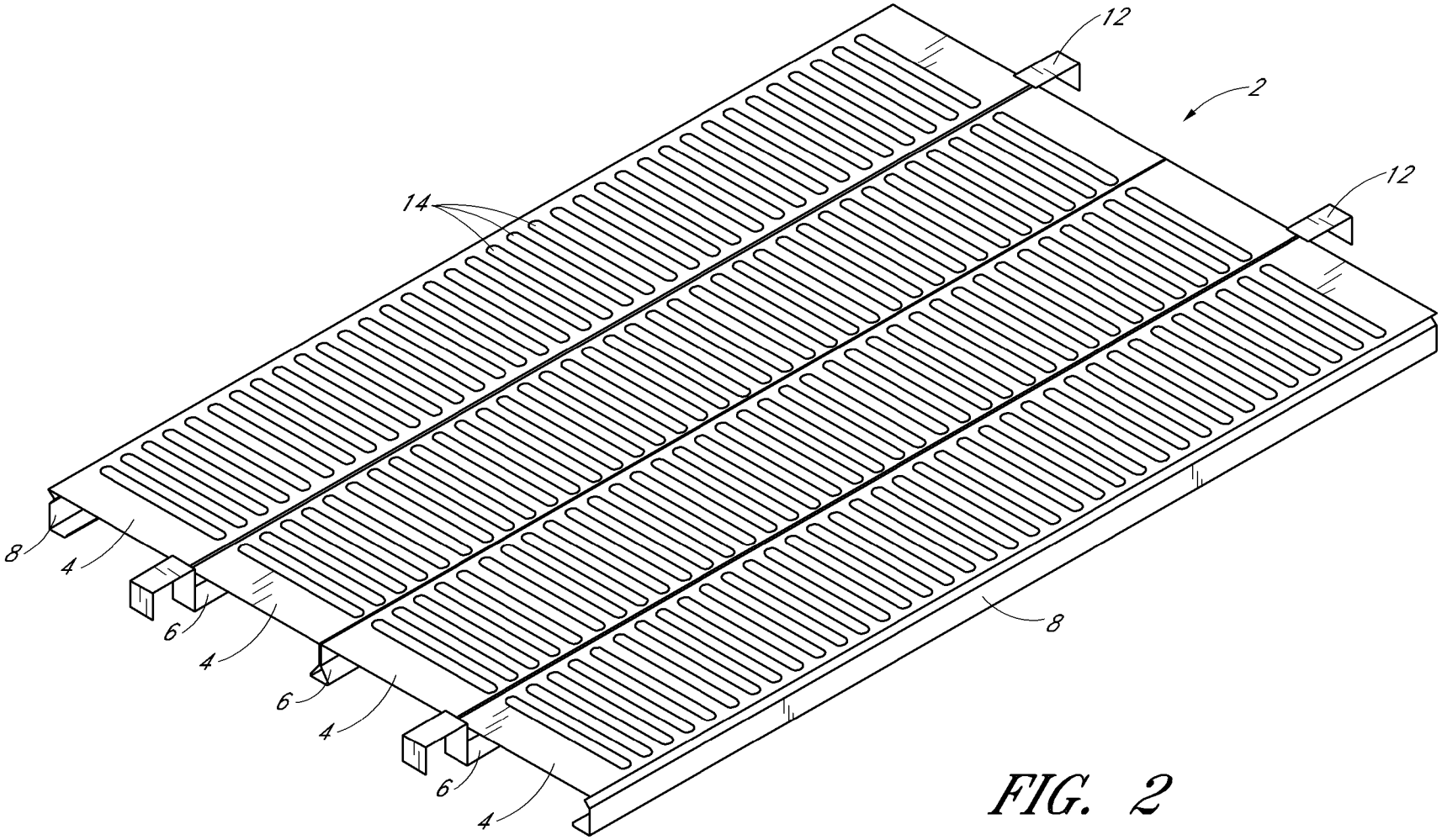
FIG. 2 is an isometric view of an embodiment of a decking member.
Figure 3:
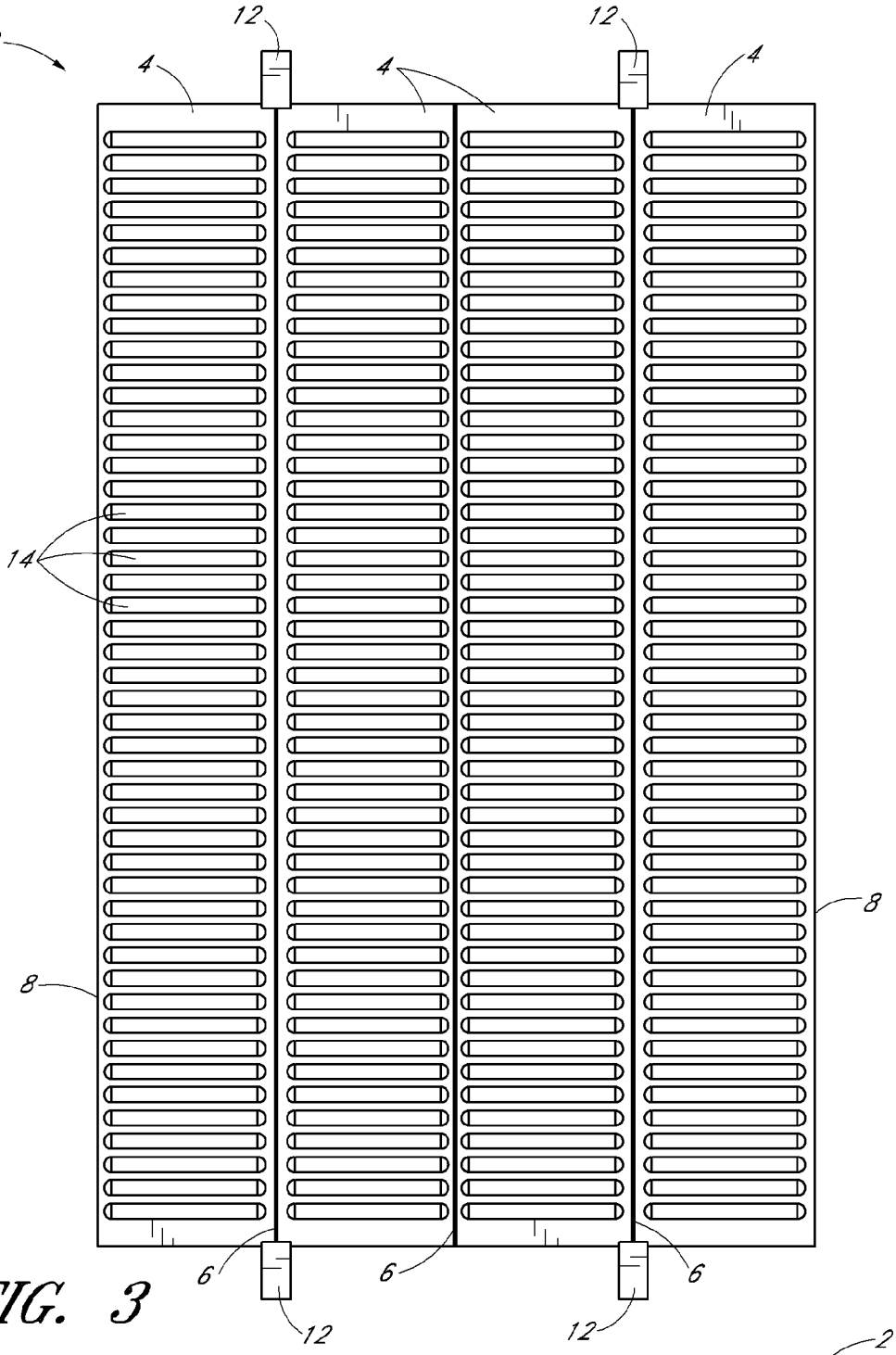
FIG. 3 is a top view of the decking member of FIG. 2.
Figure 4:
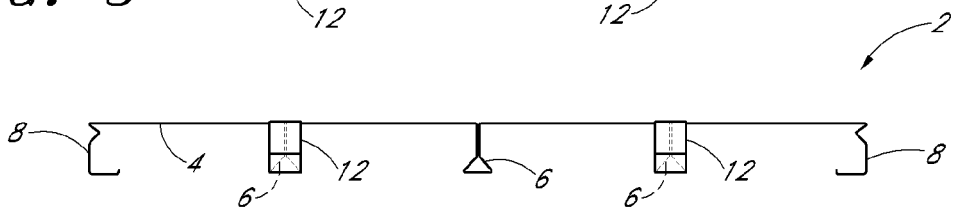
FIG. 4 is an end view of the decking member of FIG. 2.

FIGS. 2-4 show four panels 4 connected by three center supports 6 and with two side supports 8. The front and back ends both show two integral hooks 12 for attachment to the shelving system. The hooks shown can form part of the one piece construction. The panels can have a plurality of slots 14 thereon. The slots can allow for water to pass through the decking and can contribute to the ability of the decking to meet and/or exceed certain state and local building codes requirements. The slots are described in greater detail below.

Figure 5:
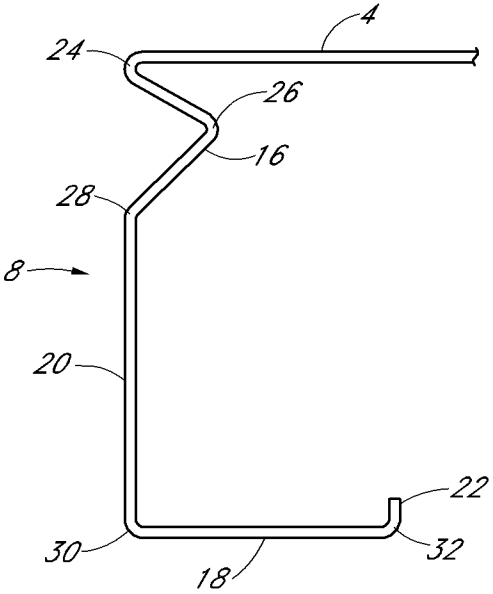
FIG. 5 is a detail view of a side support of an embodiment of a decking member.

The individual supports will now be described. FIG. 5 illustrates one embodiment of a side support 8. The side support 8 of the illustrated embodiment is generally "L" or "C" shaped with a substantially horizontal edge 18 and a substantially vertical edge 20. Side support 8 can have an indentation 16 that runs along the length of the side support 8. In some embodiments, the indentation 16 runs along or near the top region of the side support 8. The indentation 16 can have a variety of different shapes. The indentation 16 can add to the structural integrity and strength of the side support 8 and can facilitate the manufacturing process by providing a guide to direct the member through various production machines. The side support 8 of FIG. 5 is shown with a "V" shaped notch 16 that runs along the top length of the side support 8. Alternatively, side support 8 need not include an indentation 16. Horizontal edge 18 can also have a bent end 22. Bent end 22 can add to the structural integrity of the side support 8 and additionally it can ensure that no sharp edges are exposed where someone is likely to contact them. Substantially horizontal edge 18 can be configured to engage ledges (not shown) in the system frame to assist in supporting the decking member 2 in the system.

The side support 8 shown in FIG. 5 consists of five folds or bends. There is a first fold 24 where the V-notch 16 and the panel 4 connect. A second fold 26 can be found at the point of the V-notch 16. A third fold 28 is at the connection between the vertical edge 20 and the V-notch 16. There is a fourth fold 30 at the connection between the vertical 20 and horizontal 18 edges. And finally, a fifth fold 32 along the bent end 22. The side support 8 of other embodiments can have more or less folds or bends. For example, the indentation 16 of other embodiments could be U-shaped increasing the number of folds by one. As another example, the side support 8 of certain embodiments can add another fold to bent end 22 to better protect against exposed sharp edges. In other embodiments, side support 8 doesn't include indentation 16 and can be formed with fewer folds.

Figure 6:
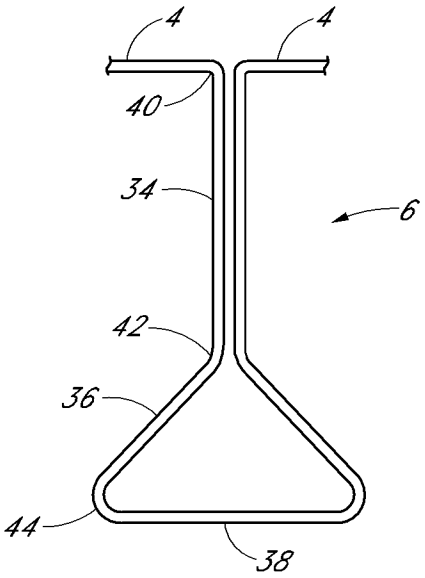
FIG. 6 is a detail view of a center support of an embodiment of a decking member.

Turning now to FIG. 6, a center support 6, which can be an I-beam type member, is shown. As illustrated, the left and right sides of the center support 6 are preferably mirror images of each other; therefore the following description only describes the left side. The center support 6 shows the top of the I-beam formed by panels 4. Substantially vertical segment 34 forms the substantially vertical part of the I-beam. The bottom of the I-beam is in the form of a triangle with sides 36 and bottom 38. In other embodiments the right and left sides are not mirror images. In some embodiments the center support 6 can have a different form than that described above. For example, the base can have a different shape than triangular, such as circular, or flat, or rectangular.

The center support 6 shown has 6 folds or bends, with 3 per side. Once again, the following will only describe the left side. A first fold 40 is at the top of the I-beam. A second fold 42 is at the bottom of the substantially vertical segment 34 of the I-beam and at the top of triangle side 36. Finally there is a third fold 44 where the side 36 and the bottom 38 of the triangle meet. As with the side support 8, the center support 6 can have more or less folds or bends and still be within the scope of this disclosure.

Figure 7:
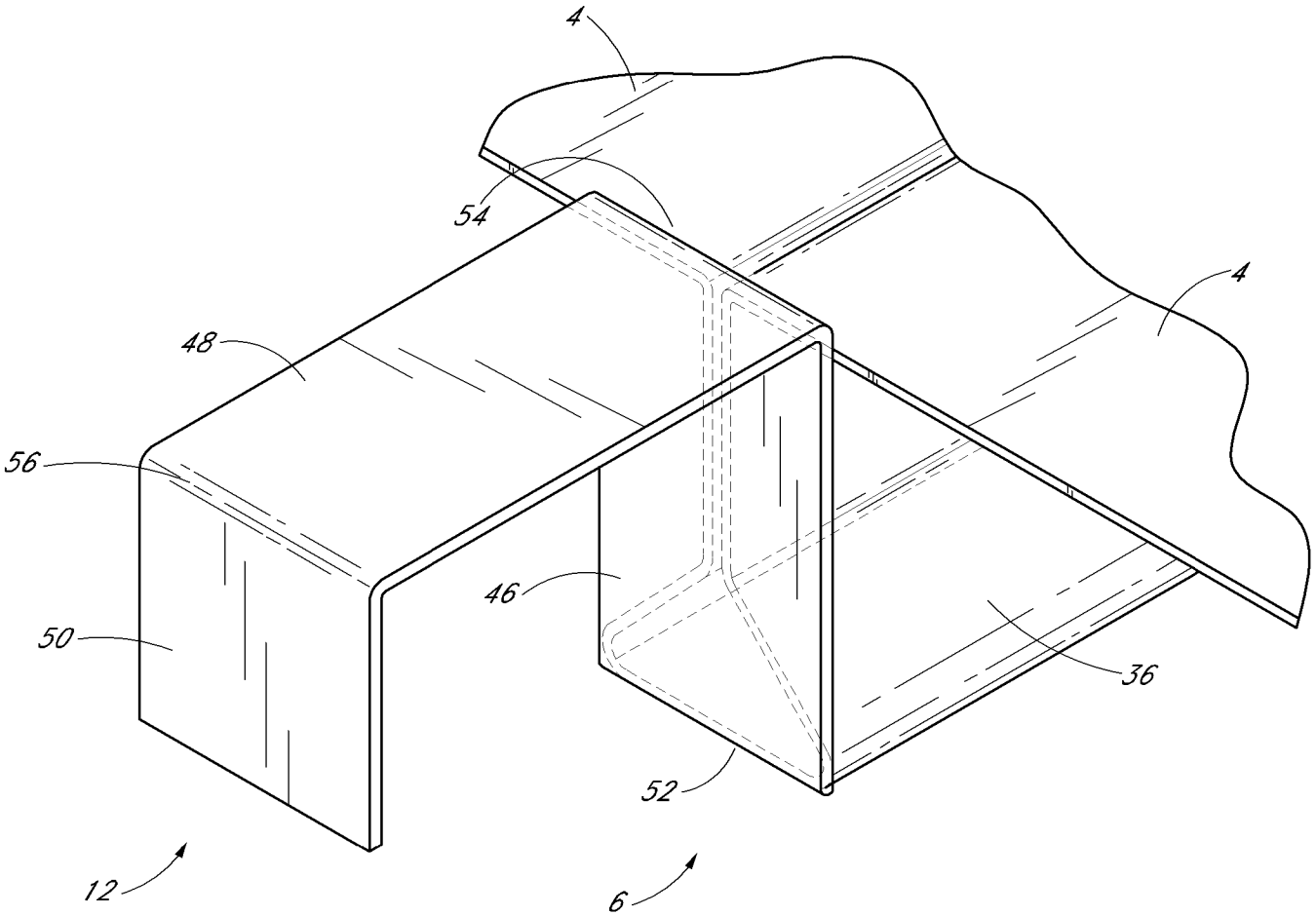
FIG. 7 is a detail view of a hook and center support on an end of an embodiment of a decking member.

FIG. 7 shows another embodiment of a center support with a hook 12 attached thereto. The hook shown has three parts, a top 48 and two sides 46, 50. Side 46 is shown attached to the center support at fold 52. The hook also has a fold 54 and 56 where the top 48 connects with the sides 46 and 50 respectively. In some embodiments, there are no hooks. In some embodiments the hook or hooks are attached to the decking member 2 at locations other than the center support 6. The embodiments shown in FIGS. 1-4 illustrate the use of four hooks, in some other embodiments more or less hooks can be used. In some embodiments, the one or more hooks 12 can cooperate with the one or more side supports 8 and/or the one or more center supports 6 to engage a frame to form a finished system. In some embodiments, the one or more hooks 12 may be connected at more than one location. For example, the hooks 12 may be welded or otherwise attached to both the center support 6 and the panel 4. In some embodiments, no hooks 12 are used.

Returning now to FIG. 2, a plurality of slots 14 are shown along the top of the panels 4. The slots 14 of one embodiment can be formed by metal punching. In one preferred embodiment the slots 14 are ½" drawn holes. The slots 14 of the preferred embodiment can form at least a 50% open deck, while maintaining the safety and strength of the decking. This can help to satisfy state and local building codes, as they often require a minimum 50% open watershed area to satisfy fire requirements. The slots 14 of other embodiments can from a 50% open deck. Still other embodiments can from less than a 50% open deck. The slots 14 can increase the strength of the deck. The number, size, position and spacing of the slots 14 can be varied according to different embodiments.

Figure 8A:
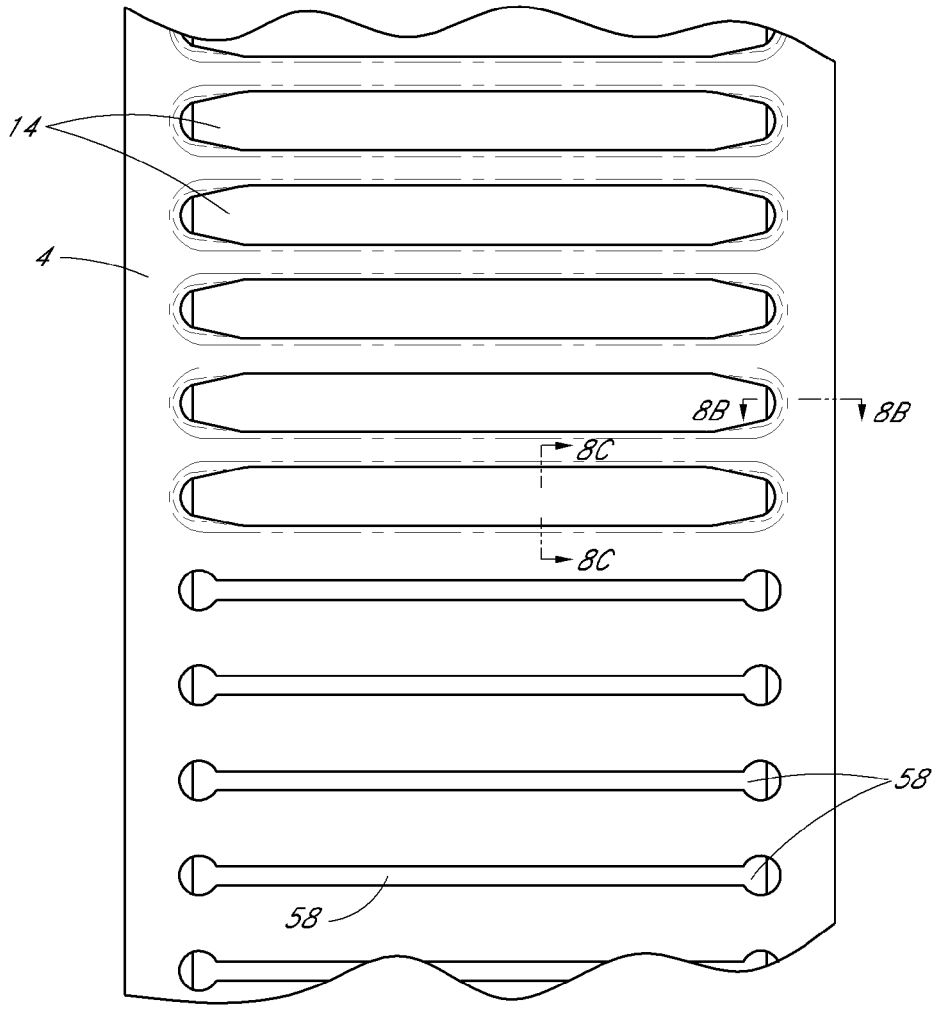
FIGS. 8A-C illustrate certain detail views of slits and slots on a decking member.
Figure 8B:
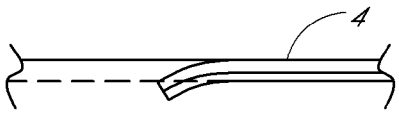
Figure 8C:
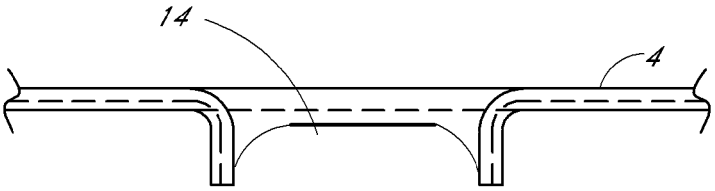

In some embodiments, slots 14 can be press cut from the panel 4 with the excess material removed and discarded or otherwise utilized. As shown in FIGS. 8A-C, in some embodiments, the slots 14 may be formed by first cutting an appropriately sized slit or slits 58 in the panel 4 and second moving the sides of the slit 58 downward to form the slot 14. In some embodiments, the sides of the slit 58 can be moved downward and outward to form the slot 14. Moving or pressing the sides of the slit 58 downward or downward and outward away from the top surface of the decking member 2 leaves a substantially smooth interface on the top surface of the panel 4 where the slots 14 meet the panel 4. The side edges of the subsequently formed slots 14 may be ground, sanded, or otherwise manipulated to reduce the likelihood they would cut a hand or other appendage that may come into contact therewith. Bending the material out of the way, thereby leaving some or all of the preexisting panel material around the slots 14, can increase the structural integrity of the decking member 2 while providing necessary watershed properties for the decking member 2.

By bending the sides of the slit 58 downward, or downward and outward, a substantially planar surface can be formed on the top of the panel 4. This can allow for the decking member 2 to have increased strength and yet still function well as part of a shelving unit, for example, where boxes or containers, etc. can easily be placed and moved around on the decking member 2.

In some embodiments, traction on the top surface of the decking member 2 can be increased by moving or bending the sides of the slits upward or upward and outward such that the edges of the slots project above the top surface of the panel 4. In some embodiments, it may be advantageous to form the slots 14 by removing some material and bending the remaining material to control how far the exposed edges project from the surface of the decking member 2, whether upward or downward.

The slots 14 formed on the decking member 2 can increase the strength of the decking member 2. For example, manufacturing the slot 14 as a drawn-hole from a slit 58, as explained above, can increase the strength of the decking member 2 verses a decking member 2 without slots 14 or with slots 14 that are solely punched out of the material.

The slits 58 of the various embodiments can be of different shapes. For example, rectangular, rectangular with two opposing rounded ends, elliptical, circular, etc. In some embodiments, as shown in FIG. 8, the slits 58 are dumbbell shaped with circular ends and a narrower connecting region. The slots 14 can also be various shapes in the different embodiments. The shape of the slot 14 may be similar to the shape of the slit 58. The shape of the slot 14 may be very different from the shape of the slit 58, as in FIG. 8. In some embodiments, the ends of the formed slots 14 are approximately ½ inch from the edges of the panels 4.

In some embodiments, the slits 58 can be formed in the shape of a dumbbell with 7/16 inch holes at the ends and 5/32 inch channels running between them. In some embodiments the slits 58 can be 4 23/32 inch from center to center of the holes. The slots 14 that are formed can be 17/32 inch channels running along the length of the slot 14. In some embodiments the length is 5½ inches where the panel is 6⅛ inches. In some embodiments there can be 13/16 inch from center to center of adjacent slots 14.

Figures 9, 9A, 9B:
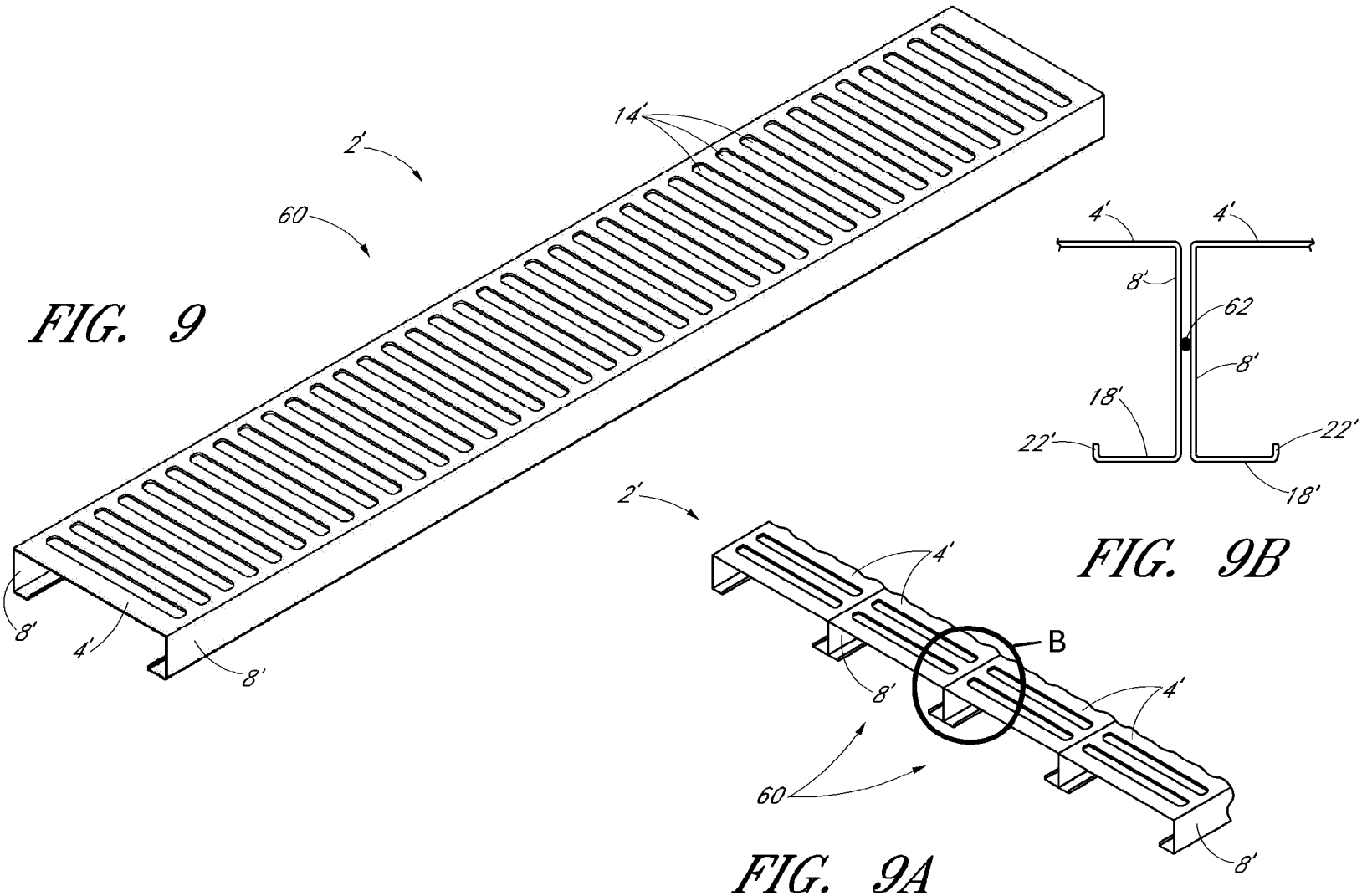
FIG. 9 is an isometric view of another embodiment of a decking member.
FIG. 9A is an isometric view of another embodiment of a decking member.
FIG. 9B is an end detail view of the decking member of FIG. 9A.

Turning now to FIGS. 9, 9A and 9B, another embodiment of a decking member 2' is shown. The decking member 2' can also be used in a rack or shelving unit together with a frame. The decking member 2' can be manufactured according to the desired size. In some embodiments, the decking member 2' can comprise one or more decking units 60. Where there are more than one decking units 60, the decking units can be joined together along the side supports 8' to create the decking member 2'. For example the decking units 60 can comprise a connection 62, wherein the connection can be formed by welding, spot welding, riveting, bolting them together, etc. The decking member 2' can comprise one, two or more decking units 60 and preferably comprises four decking units 60. The decking member 2' can also comprise hooks (not shown) or other devices to connect the decking member 2' to a frame or shelving unit. In some embodiments, the decking member 2° can fit into or on a frame such that hooks or other connection devices are not necessary.

The decking member 2' can have an at least a 50% open deck. In some embodiments the slots 14' form at least a 50% open deck. In some embodiments, the sides of the decking units 60 that are connected together along the side supports 8' can be open to water flow. In these embodiments, these joints together with the slots 14' can form at least a 50% open deck.

Figure 10:
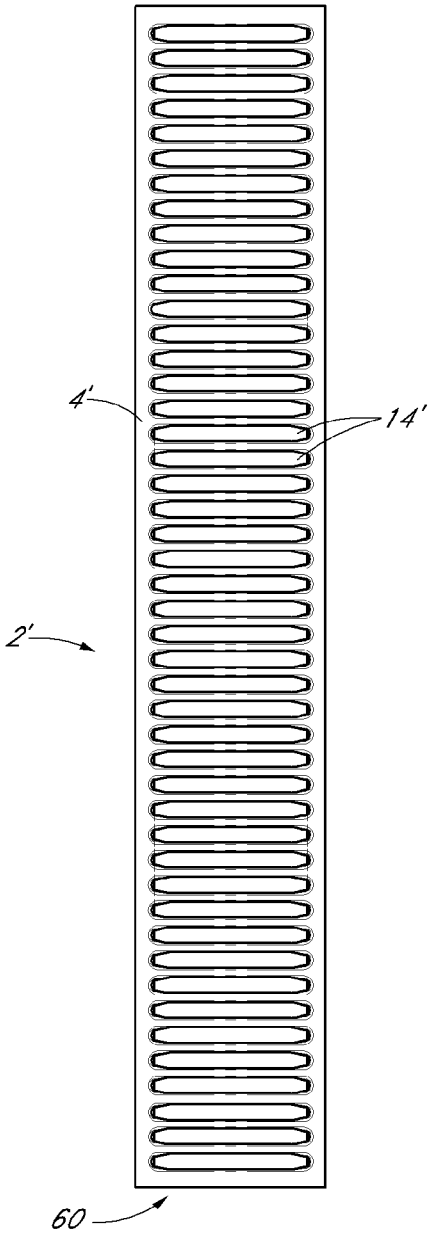
FIG. 10 is a top view of another embodiment of a decking member.
Figure 11:
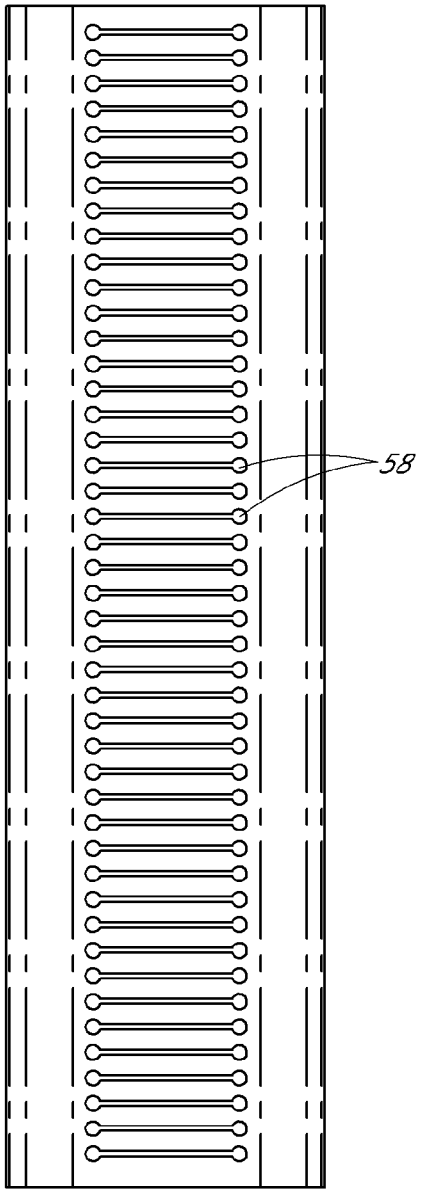
FIG. 11 is a top view of the decking member of FIG. 10 shown during a manufacturing process according to certain methods.

FIGS. 10 and 11 illustrate a decking member 2' according to certain embodiments and part of a method of making a decking member 2'. The decking member 2' in FIG. 10 can be the final product or it can be one of the decking units 60 to be made into a final decking member 2' having multiple connected decking units 60. FIG. 11 shows the decking member 2' in an intermediary condition. The decking member 2' or decking unit 60 can be forming of a single piece of material, such as metal. According to certain methods, a piece of material can be cut to a desired size and the slits 58 can be punched out, with for example, a punch press. The piece of material can then be roll formed to attain the desired final shape as discussed previously. Either before or after this step, slots 14 can be formed as also discussed above.

Figure 12:
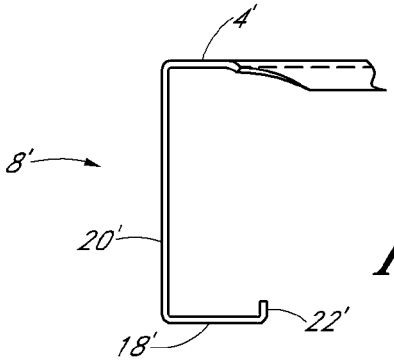
FIG. 12 shows an end view and an end detail view of the decking member of FIG. 10.

Referring to FIG. 12, a front view of a decking member 2' or decking unit 60 is shown. The decking member 2' or decking unit 60 can have a side support 8'. The side support 8' shown, has a substantially vertical edge 20' and a substantially horizontal edge 18'. Also shown is a bent end 22'. Similar to the prior embodiments the decking member 2' or decking unit 60 can have a side support 8' different from that shown, with for example, an indentation or other shape.

Embodiments of the disclosed invention have many benefits. The decking can be manufactured in varying widths and depths accommodating all bay sizes. In some embodiments, the decking member has an outer width dimension extending between the side supports on the ends in the range of approximately 20 to approximately 48 inches. In some embodiments, the outer width dimension is in the range of approximately 24 to 27 inches. In some embodiments, outer width is one of 24, 36, 42 or 48 inches. In some embodiments, the panels can be one of approximately 4, 5, 6 and 7 inches. In some embodiments, the decking has an outer length dimension in the range of approximately 15 to approximately 50 inches. In some embodiments, the outer length is one of approximately 20.5, 32.5, 38.5 and 44.5 inches. In some embodiments, the ratio of the width to the length of the decking member is approximately 1 to 1. In some embodiments, the ratio is approximately 1 to 2. In some embodiments, the height of the decking member can be one of approximately 1, 1.5, 1 9/16 and 2 inches. The embodiments shown in the figures have nesting capabilities which can decrease air space during shipments. The decking can have a durable powder coat finish process, which is generally preferred over other types of finish.

The front to back triangular shaped channels can create a flat surface and add strength. Also the embodiments with multiple decking units connected to form the decking member can also have a flat surface and add strength. The different embodiments can be manufactured to create a lightweight deck allowing one-person installation.

In addition, the disclosed embodiments can have a high weight capacity and, in particular, a high weight capacity versus their own weight. For example, applicants have found that a 20 gauge, 24½"×44½" deck design according to some embodiments has a 3500 lb. capacity, with a 2 to 1 safety factor that can meet certain Rack Manufacturers Institute (RMI) guidelines.

While the described in terms of specific embodiments, it is implicit that the invention is not limited to these disclosed examples. The invention may be embodied in many different varieties and should not be construed as limited to the embodiments set forth herein; rather these embodiments are provided by illustration purposes only. Undeniably, many modifications and other embodiments of the invention will come to mind of those skilled in the art to which the invention pertains, and which are intended to be and are covered by this disclosure, the drawings, and the claims.

The invention claimed is:

1. A decking member, roll-formed from a single piece of material with a series of folds, the decking member comprising:

a first end and a second end of a plurality of upper surfaces; wherein each upper surface further comprises a plurality of slots;

a first side support, folded perpendicular to the first end; wherein the first side support further comprises:

a vertical edge, folded to the first side support;

a horizontal edge, folded to the vertical edge with a first fold;

a second side support, folded perpendicular to the second end; and at least one center support folded between and connecting adjacent ones of the upper surfaces; wherein the at least one center support further comprises a lower surface parallel to the plurality of upper surfaces; wherein the lower surface is unperforated;

a bent end, parallel to the vertical edge and perpendicular to the horizontal edge; wherein the bent end is joined to the horizontal edge with a second fold a third fold connected to a V-shaped notch and the first end of the plurality of upper surfaces;

a fourth fold, formed at an innermost point of the V-shaped notch; and a fifth fold, formed at a connection between the vertical edge and the V-shaped notch.

2. The decking member of claim 1, wherein the plurality of upper surfaces comprise the plurality of slots forming an open deck of at least 50% of open surface area.

3. The decking member of claim 1, wherein the at least one center support has a region perpendicular to the plurality of upper surfaces and a triangular base.

* * * * *